US011072878B2

(12) United States Patent
Jung et al.

(10) Patent No.: US 11,072,878 B2
(45) Date of Patent: Jul. 27, 2021

(54) LAUNDRY PROCESSING APPARATUS AND CONTROL METHOD THEREFOR

(71) Applicant: LG ELECTRONICS INC., Seoul (KR)

(72) Inventors: Jongseok Jung, Seoul (KR); Sungha Ryu, Seoul (KR); Jungyeol Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 320 days.

(21) Appl. No.: 16/069,870

(22) PCT Filed: Jan. 16, 2017

(86) PCT No.: PCT/KR2017/000509

§ 371 (c)(1),
(2) Date: Jul. 12, 2018

(87) PCT Pub. No.: WO2017/123067

PCT Pub. Date: Jul. 20, 2017

(65) Prior Publication Data

US 2019/0024281 A1 Jan. 24, 2019

(30) Foreign Application Priority Data

Jan. 15, 2016 (KR) ..... 10-2016-0005588

(51) Int. Cl.
*D06F 31/00* (2006.01)
*D06F 33/00* (2020.01)
(Continued)

(52) U.S. Cl.
CPC ..... *D06F 31/00* (2013.01); *D06F 23/02* (2013.01); *D06F 23/04* (2013.01); *D06F 33/00* (2013.01);
(Continued)

(58) Field of Classification Search
CPC ..... D06F 25/00; D06F 29/00; D06F 29/005; D06F 31/00; D06F 33/00; D06F 37/04;
(Continued)

(56) References Cited

U.S. PATENT DOCUMENTS 4,335,591 A * 6/1982 Gillespie ..... D06F 33/00 68/12.23
7,621,012 B2 * 11/2009 Kim ..... D06F 33/00 8/147
(Continued)

FOREIGN PATENT DOCUMENTS

JP H10-015276 1/1998
KR 10-2010-0118227 11/2010
(Continued)

OTHER PUBLICATIONS

International Search Report (with English Translation) and Written Opinion dated Apr. 21, 2017 issued in Application No. PCT/KR2017/000509.

*Primary Examiner* — Joseph L. Perrin
(74) *Attorney, Agent, or Firm* — Ked & Associates, LLP

(57) ABSTRACT

The present invention relates to a laundry processing apparatus and a control method therefor, and to a laundry processing apparatus having a plurality of washing parts for performing washing independently of each other, the apparatus: determining whether the plurality of washing parts simultaneously perform washing; and determining whether a simultaneous operation is performed on the basis of the time required when water is supplied, so as to determine an error for the simultaneous operation on the basis of a standard different from an error determination standard during a single operation, thereby reducing the errors frequently occurring because of the simultaneous operation in a normal state.

15 Claims, 7 Drawing Sheets

(51) Int. Cl.

| | |
|---|---|
| ***D06F 37/04*** | (2006.01) |
| ***D06F 23/02*** | (2006.01) |
| ***D06F 23/04*** | (2006.01) |
| ***D06F 37/12*** | (2006.01) |
| ***D06F 37/30*** | (2020.01) |
| ***D06F 39/04*** | (2006.01) |
| ***D06F 39/08*** | (2006.01) |
| ***D06F 29/00*** | (2006.01) |
| ***D06F 34/28*** | (2020.01) |
| ***D06F 35/00*** | (2006.01) |
| ***D06F 25/00*** | (2006.01) |

(52) U.S. Cl.
CPC ..... *D06F 37/04* (2013.01); *D06F 37/12* (2013.01); *D06F 37/304* (2013.01); *D06F 39/045* (2013.01); *D06F 39/087* (2013.01); *D06F 25/00* (2013.01); *D06F 29/005* (2013.01); *D06F 34/28* (2020.02); *D06F 35/006* (2013.01); *D06F 35/007* (2013.01); *D06F 2202/085* (2013.01); *D06F 2204/086* (2013.01); *D06F 2212/06* (2013.01)

(58) Field of Classification Search
CPC ..... D06F 37/22; D06F 37/40; D06F 39/00; D06F 39/006; D06F 2202/12; D06F 2204/10; D06F 2212/02; D06F 2220/00; D06F 33/34; D06F 34/44; D06F 34/14; D06F 35/00; D06F 35/006; D06F 39/045; D06F 39/08; D06F 39/087; D06F 39/088
See application file for complete search history.

(56) References Cited

U.S. PATENT DOCUMENTS

| | | | | |
|---|---|---|---|---|
| 2007/0151300 | A1* | 7/2007 | Sunshine | D06F 29/005 68/3 R |
| 2010/0269266 | A1 | 10/2010 | Lee et al. | |
| 2010/0275381 | A1 | 11/2010 | Ko et al. | |
| 2011/0016640 | A1* | 1/2011 | Kim | D06F 33/00 8/137 |
| 2011/0041258 | A1 | 2/2011 | Ko et al. | |
| 2011/0048079 | A1* | 3/2011 | Kim | D06F 37/42 68/13 R |
| 2011/0185511 | A1* | 8/2011 | Ryoo | D06F 39/088 8/137 |
| 2017/0335500 | A1* | 11/2017 | Li | D06F 29/005 |
| 2017/0342626 | A1* | 11/2017 | Li | D06F 39/04 |

FOREIGN PATENT DOCUMENTS

| | | |
|---|---|---|
| KR | 10-2010-0118637 | 11/2010 |
| KR | 10-2011-0019082 | 2/2011 |
| KR | 10-2013-0123654 | 11/2013 |

* cited by examiner

LAUNDRY PROCESSING APPARATUS AND CONTROL METHOD THEREFOR

TECHNICAL FIELD

The present invention relates to a laundry processing apparatus having a plurality of washing parts, and more particularly, to a laundry processing apparatus for determining an error for an operation which is delayed as washing progresses simultaneously, and a method therefor.

BACKGROUND ART

Generally, a laundry processing apparatus is an apparatus that processes laundry through various operations such as washing, spin-dry and/or drying.

The laundry processing apparatus is an apparatus that supplies water to immerse the laundry, and dissolves an appropriate amount of the detergent in the wash water to remove the impurities from the laundry.

Such a laundry processing apparatus includes a laundry processing apparatus that washes laundry such as clothing or bedding by using the emulsifying action of the detergent, the water current action caused by the rotation of the washing tub or the laundry blade, and a mechanical force applied by the laundry blade, a dryer that applies a hot air or a cold air to dry the laundry, and a refresher that removes the wrinkles of the clothes by applying steam. In addition, a washer-drier provides a combination of various functions.

The laundry processing apparatuses are produced in various shapes and sizes depending on their use. In recent years, a mini laundry processing apparatus for processing a small amount of laundry, or a laundry processing apparatus for babies has also appeared according to a specific purpose.

A general laundry processing apparatus should be supplied with a minimum amount of wash water for performing washing. In the case where a washing tub having a large capacity is provided, there is a problem in that a large amount of wash water is required even when washing a small amount of laundry.

In response to this demand, a mini laundry processing apparatus for washing a small amount of laundry or a laundry processing apparatus for babies has been appeared. Further, there is a tendency to develop a laundry processing apparatus having a plurality of washing parts having different capacities.

However, in the case of a mini laundry processing apparatus, it is required to purchase a separate laundry processing apparatus. In the case of a laundry processing apparatus having a plurality of washing parts, when a plurality of washing parts simultaneously perform washing, there is a problem in that vibration of any one side affects other washing parts or the water supply consumes a long time as the water supply is simultaneously progressed.

Accordingly, there is a need for a method for allowing a plurality of washing parts to easily perform washing simultaneously.

DISCLOSURE

Technical Problem

It is an object of the present invention to provide a laundry processing apparatus and a control method therefor, in which a laundry processing apparatus having a plurality of washing parts for performing washing independently of each other determines whether the plurality of washing parts simultaneously perform washing, and processes an error determination differently from the case where any single washing part performs washing.

Technical Solution

In an aspect, there is provided a laundry processing apparatus including: a first washing part having a first tub; a second washing part having a second tub and operating independently of the first washing part; and a controller for controlling the first washing part, wherein the controller determines whether the first washing part and the second washing part operate simultaneously, sets a simultaneous operation mode, and when the simultaneous operation mode is set, changes standard data for determining operating state of the first washing part, and controls operation of the first washing part according to the changed standard data.

The apparatus further includes: a water level sensor for detecting level of wash water that is supplied to the first tub, wherein the controller determines a water level change in response to water level data of the first tub inputted by the water level sensor and, when the water level change is equal to or less than a set value, determines that water supply is performed simultaneously due to the simultaneous operation of the first washing part and the second washing part, and sets the simultaneous operation mode.

The controller determines that failure of water supply is occurred and outputs an error when water level of the first washing part is not changed for a certain time, in response to the water level data.

The controller sets the simultaneous operation mode when water supply time of the first washing part exceeds a set time.

The apparatus further includes an input unit having a simultaneous operation key, wherein the controller sets the simultaneous operation mode, when the simultaneous operation key is input.

The controller sets the simultaneous operation mode, when receiving operation data from the second washing part during the operation of the first washing part.

The controller measures and stores a water supply completion time and a water level change amount of the first washing part, when the simultaneous operation mode is set, and determines whether the first washing part and the second washing part simultaneously operate based on stored data and sets the simultaneous operation mode, in a next operation.

The controller changes the standard data, which is a standard for an error determination on the operation of the first washing part, when the simultaneous operation mode is set.

The controller changes the standard data for at least one of a water supply time, a draining time, a heating target temperature of a heater, and a wash water heating time.

After setting the simultaneous operation mode, the controller outputs a water supply error when the water supply is not completed within a changed water supply time, in response to the changed standard data.

The controller transmits information on simultaneous operation mode setting to the second washing part, when the simultaneous operation mode is set.

In another aspect, there is provided a method of controlling a laundry processing apparatus including a first washing part having a first tub and a second washing part having a second tub and operating independently of the first washing part, the method including: determining whether the first washing part and the second washing part operate simultaneously and sets a simultaneous operation mode, by a controller for controlling the first washing part; changing standard data for the first washing part, when the simultaneous operation mode is set; and controlling operation of the first washing part according to the changed standard data.

The method further includes: detecting a water level of wash water supplied to the first tub, before setting the simultaneous operation mode; and determining a water level change in response to water level data of the first tub; wherein, when the water level change is equal to or less than a set value, it is determined that the first washing part and the second washing part simultaneously operate and water supply is performed simultaneously and sets the simultaneous operation mode.

The method further includes: determining that failure of water supply is occurred and outputting an error when water level of the first washing part is not changed for a certain time, in response to the water level data.

The method further includes: counting a water supply time of the first washing part and comparing the water supply time with a set time, wherein the simultaneous operation mode is set when the water supply time exceeds the set time.

The method further includes: receiving a simultaneous operation key, wherein, when the simultaneous operation key is input, the simultaneous operation mode is set.

The method further includes: receiving operation data from a second controller of the second washing part during operation of the first washing part, wherein the simultaneous operation mode is set in response to the operation data.

The method further includes: measuring and storing a water supply completion time and a water level change amount of the first washing part when the simultaneous operation mode is set, wherein it is determined whether the first washing part and the second washing part simultaneously operate based on stored data and the simultaneous operation mode is set, in a next operation.

When the simultaneous operation mode is set, the standard data for at least one of a water supply time, a draining time, a heating target temperature of a heater, and a wash water heating time is changed.

Advantageous Effects

The laundry processing apparatus and the control method of the present invention configured as described above, when the plurality of washing parts operating independently of each other are simultaneously performing the washing, determine a mode setting on whether the plurality of washing parts simultaneously perform washing or determine whether a simultaneous operation is performed on the basis of the time required when water is supplied, so as to determine an error for the simultaneous operation on the basis of a standard different from an error determination standard during a single operation, thereby reducing the errors frequently occurring because of the simultaneous operation in a normal state.

MODE FOR INVENTION

Hereinafter, preferred embodiments of the present invention will be described with standard to the accompanying drawings. In describing the present embodiment, the same designations and the same standard numerals are used for the same components, and further description thereof will be omitted.

Figure 1:
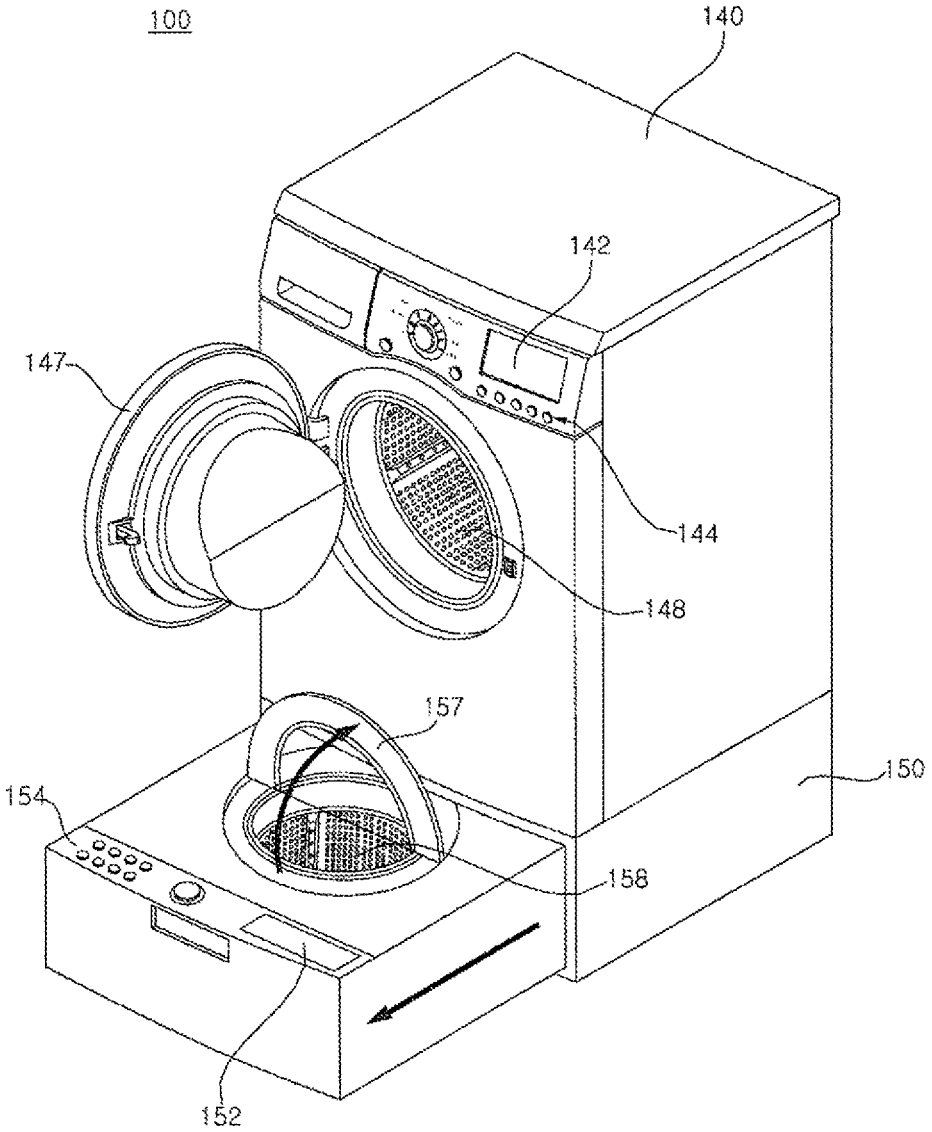
FIG. 1 is a perspective view illustrating a laundry processing apparatus according to an embodiment of the present invention.

FIG. 1 is a perspective view illustrating a laundry processing apparatus according to an embodiment of the present invention.

Referring to FIG. 1, a laundry processing apparatus 100 includes a first washing part 140 and a second washing part 150.

The first washing part 140 and the second washing part 150 are disposed vertically. The first washing part 140 is disposed above the second washing part 150 and the first washing part 140 and the second washing part 150 can be coupled to and separated from each other.

The first washing part 140 is in the form of a front load laundry processing apparatus and the second washing part 150 is in the form of a top load laundry processing apparatus.

The second washing part 150 has a structure in which it is slidably opened and closed in the front and rear direction like a drawer. When the second washing part 150 is pulled to the front, the upper end of the second washing part 150 is exposed. A second input unit 154, a second output unit 152, and a second door 157 are disposed in the upper end of the second washing part 150.

The first washing part 140 may include a first input unit 144, a first output unit 142 and a first door 147. The second washing part 150 may include the second input unit 154, the second output unit 152, and the second door 157.

The first washing part 140 and the second washing part 150 are provided with separate input units 144 and 154 and output units 142 and 152, so that a command can be input independently of each other and an operation corresponding to the inputted command can be performed.

The first washing part 140 and the second washing part 150 may respectively include a water storage tank for containing water, a tub 148, 158 which accommodates laundry and is rotatably installed in the water storage tank, a motor for rotating the tub, a water supply device for supplying water into the water storage tank or the tub, and a draining device for draining water in the water storage tank, and perform washing independently of each other.

It is shown in the drawing that the capacity of the tub of the first washing part 140 is larger than the capacity of the tub of the second washing part 150. However, the capacity of the tub of the first washing part 140 may be equal to or smaller than the capacity of the tub of the second washing part 150. The tub capacity of each of the washing parts 140 and 150 is not limited.

The first washing part 140 and the second washing part 150 may be a washer-drier for simultaneously providing a washing function and a drying function.

Figure 2:
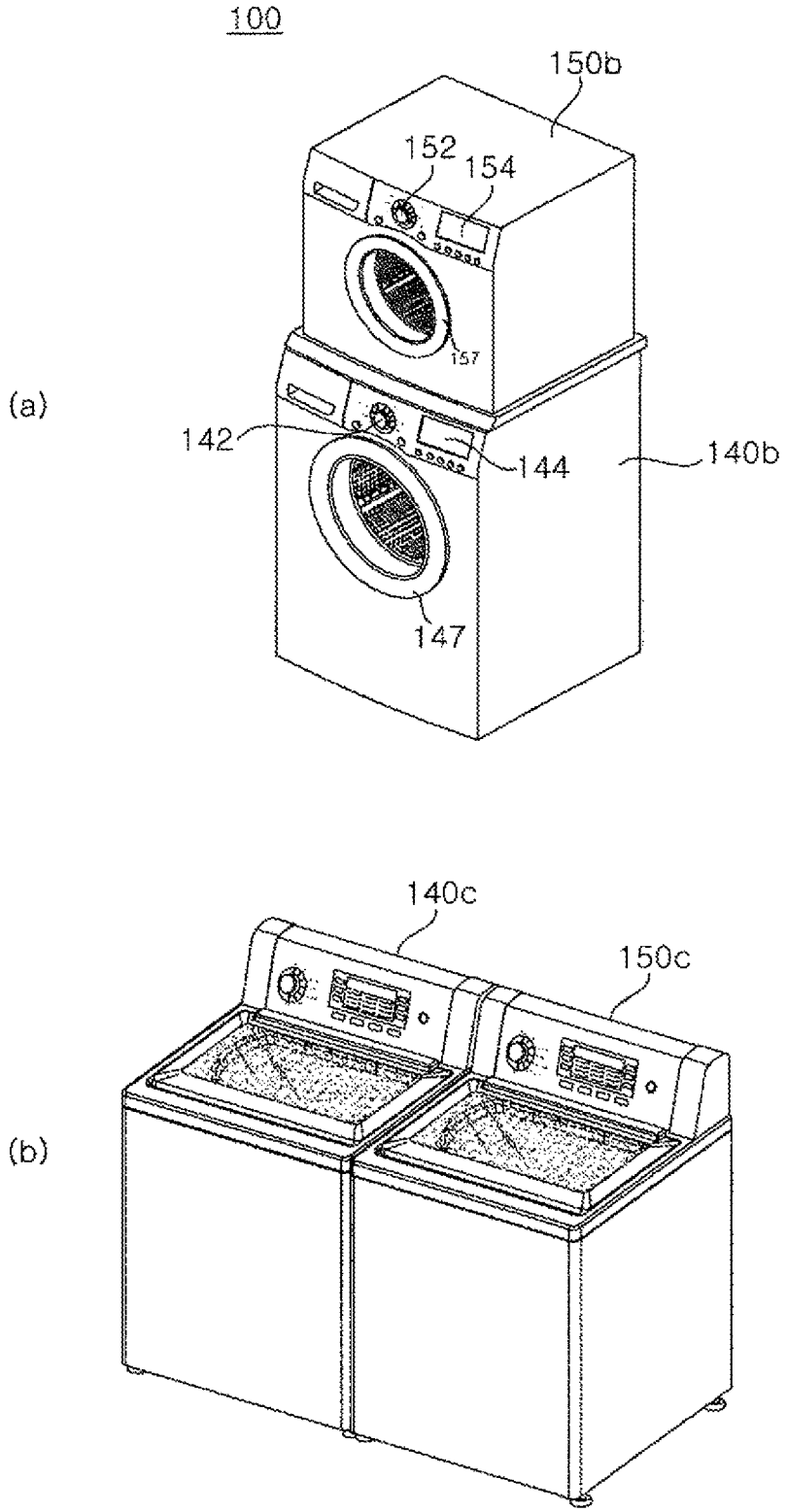
FIG. 2 is a perspective view illustrating a shape of a laundry processing apparatus according to another embodiment of the present invention.

FIG. 2 is a perspective view illustrating a shape of a laundry processing apparatus according to another embodiment of the present invention.

As shown in FIG. 2(*a*), in the laundry processing apparatus, both the first washing part 140*b* and the second washing part 150*b* may be in the form of a front load laundry processing apparatus.

In addition, in the laundry processing apparatus, the second washing part 150*b* may be disposed above the first washing part 140*a*.

As shown in FIG. 2(*b*), in the laundry processing apparatus, both the first washing part 140*c* and the second washing part 150*c* may be in the form of a top load laundry processing apparatus.

In addition, in the laundry processing apparatus, the first washing part 140 and the second washing part 150 may not be disposed vertically, but may be disposed laterally.

Hereinafter, the laundry processing apparatus will be illustrated that, as shown in FIG. 1, the first washing part 140 and the second washing part 150 are vertically disposed, but the disposition and form are not limited.

Figure 3:
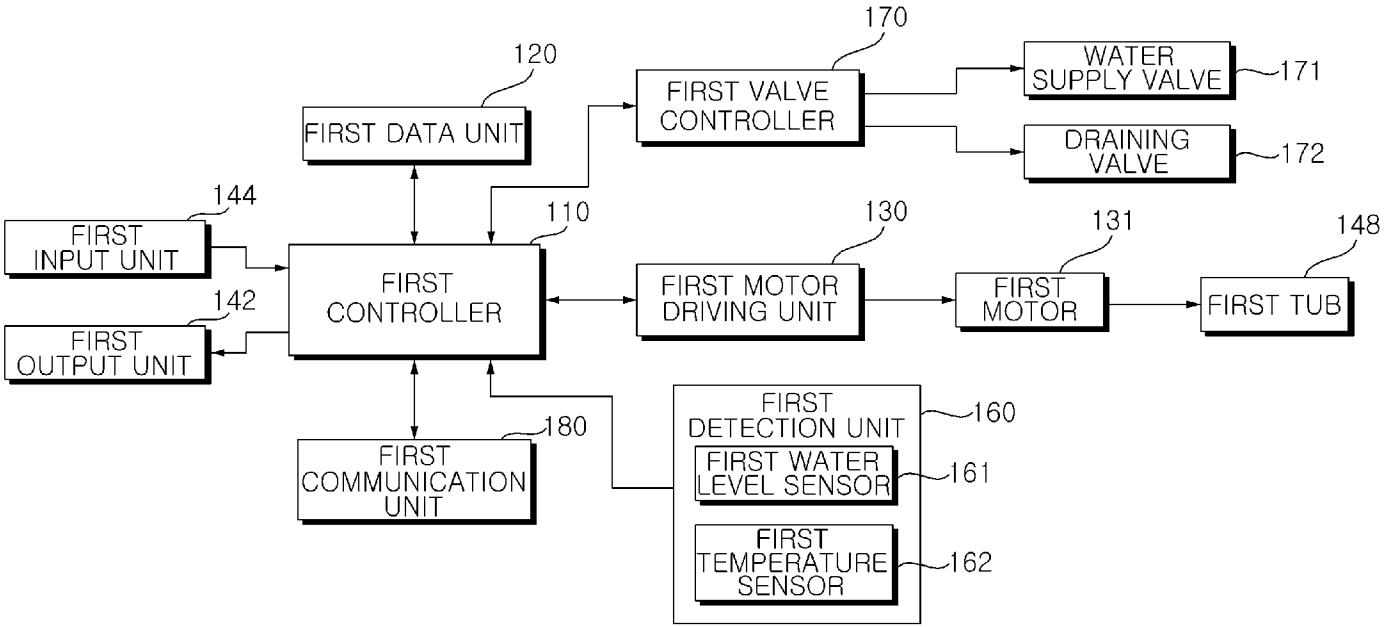
FIG. 3 is a block diagram illustrating a configuration of a first washing part of a laundry processing apparatus according to an embodiment of the present invention.

FIG. 3 is a block diagram illustrating a configuration of a first washing part of a laundry processing apparatus according to an embodiment of the present invention.

As shown in FIG. 3, the first washing part 140 includes a first input unit 144, a first output unit 142, a first tub 148, a first motor 131, a first motor driving unit 130, a first valve controller 170, a water supply valve 171, a draining valve 172, a first detection unit 160, a first communication unit 180, a first data unit 120, and a controller 110 for controlling the overall operation of the first washing part 140.

The first input unit 144 includes input means such as at least one button, a switch, and a touch pad, and inputs operation settings such as a power input, a washing course, a water level, a temperature, and the like.

The first input unit 144 includes a simultaneous operation key indicating that the first washing part 140 and the second washing part 150 operate simultaneously. When operating the simultaneous operation key, the first input unit 144 inputs data related to simultaneous operation to the first controller 110. In this case, when the first input unit 1440 is not provided with a separate simultaneous operation key, it inputs the data related to simultaneous operation to the first controller 110, when at least two buttons among a plurality of buttons are operated simultaneously or when at least two buttons are operated in a specific order.

The first output unit 142 includes a display unit that displays information on operation settings input by the first input unit 144 and outputs an operation state of the laundry processing apparatus, and includes a speaker, a buzzer, and the like that outputs a certain sound effect or warning sound.

The first data unit 120 stores control data for controlling the operation of the laundry processing apparatus, input operation setting data, data on the washing course, and standard data for determining whether an error is occurred in the laundry processing apparatus. In addition, the first data unit 120 stores data sensed or measured during operation of the laundry processing apparatus and data received through the first communication unit 180.

The first communication unit 180 is connected to the second washing part 150 in a wired or wireless manner to transmit and receive data. The first communication unit 180 may transmit information on start of washing or operation data, at the start of washing, in response to a control command of the first controller 110.

The first detection unit 160 includes a plurality of sensors to measure a voltage or a current of the laundry processing apparatus, and measures data such as temperature and water pressure and inputs the measured data to the first controller 110.

In particular, the first detection unit 160 includes a first water level sensor 161 and a first temperature sensor 162. The first water level sensor 161 is installed in the first tub 148 and detects the water level of the wash water and inputs water level data to the first controller 110. Further, the first temperature sensor 162 measures the water temperature of the wash water. At this time, a plurality of first temperature sensors are provided in different positions, and can sense not only the temperature of the wash water, but the temperature inside the control circuit, and the temperature of a heater when a heater for heating the wash water or drying is provided.

The first valve controller 170 controls to supply wash water to the first tub 148 during a washing or rinsing process, in response to a control command of the first controller 110, controls the water supply valve 171 so that the supply of wash water is stopped when reaching a set water level, and controls the draining valve 172 so that the wash water in the first tub 148 is drained during the washing, rinsing, and spin-dry processes.

At this time, the first valve controller 170 counts the water supply time when controlling the water supply valve 171, and counts the draining time when controlling the draining valve 172 to input to the first controller 110.

The first motor driving unit 130 supplies the operating power so that the first motor 131 connected to the first tub rotates, according to the control command of the first controller 110. The first motor driving unit 130 controls the rotation direction, the rotation angle, and the rotation speed of the first motor 131 according to the setting. The first motor driving unit 130 controls the first motor 131 to operate differently according to the set washing course, and the progressing washing, rinsing, and spin-dry.

At this time, the first motor driving unit 130 differently controls the rotation direction, the rotation angle, and the rotation speed of the first motor so that the wash water in the first tub 148 forms a water current of specific shape.

The first controller 110 applies a control command to the first valve controller 170 and the first motor driving unit 130 according to the operation setting inputted from the first input unit 144, so that the water supply and the draining to the first tub 148 can be performed, and the washing can be perform by rotating the first tub 148 according to the operation of the first motor 131. The first controller 110 controls a series of washing processes of washing, rinsing, and spin-dry.

The first controller 110 stores the input operation setting in the first data unit 120 and outputs the operation setting or operation state through the first output unit 142. In addition, the first controller 110 controls the operation data to be transmitted to the second washing part 150 through the first communication unit 180.

The first controller 110 changes standard data for determining the operation state in response to whether the first washing part and the second washing part operate simultaneously. The first controller 110 changes standard data for determining whether an error is occurred among a plurality of standard data. At this time, the first controller changes the standard data for at least one of the water supply time, the draining time, the heating target temperature of the heater, and the wash water heating time. The changed standard data is standard data for simultaneous operation.

The first controller 110 sets a simultaneous operation mode and changes the standard data, when the simultaneous operation key of the first input unit 144 is inputted, or when data according to the simultaneous operation is input. At this time, the first controller 110 determines an error for the operation of the laundry processing apparatus based on the standard data for simultaneous operation stored in the first data unit 120.

The first controller 110 can set the simultaneous operation mode based on the operation data of the second washing part 150 received through the first communication unit 180. When the operation of the first washing part is set and the second washing part 150 also performs the operation, the first controller 110 determines that the first washing part and the second washing part operate simultaneously and set the simultaneous operation mode. At this time, when performing washing, the first washing part 140 transmits the operation data to the second washing part 150 through the first communication unit 180 so that the second washing part 150 can determine whether the first washing part is operating.

In addition, the first controller 110 may determine whether the first washing part and the second washing part operate simultaneously based on the operation state of the laundry processing apparatus, and set the simultaneous operation mode.

For example, the first controller 110 can set the simultaneous operation mode when the water supply time exceeds a set time, at the beginning of washing.

Although the first washing part 140 and the second washing part 150 operate independently of each other, the respective water supply valves are connected to a single water pipe. Therefore, when the first washing part and the second washing part simultaneously perform water supply, the wash water may be limited so that it may take a lot of time to supply water in comparison with the case of a single operation.

Accordingly, the first controller 110 sets the simultaneous operation mode based on the water supply time and changes the standard data.

The first controller 110 may transmit a signal for changing the standard data to the second washing part, when the simultaneous operation mode is set. Thus, the second controller of the second washing part sets the simultaneous operation mode and changes the standard data.

In addition, the first controller may transmit the standard data for simultaneous operation of the second washing part to the second washing part, when the standard data for simultaneous operation of the second washing part is stored in the first data unit.

In the simultaneous water supply situation as above, even if the first washing part and the second washing part operate normally, the water supply time may be exceeded and an error may occur. Therefore, the first controller 110 sets the simultaneous operation mode and changes the standard data, and determines an error according to the data set differently from the case of a single operation. That is, the first controller 110 changes the standard of the error determination for the water supply time in the case of a single operation and the water supply time in the case of simultaneous operation so that no error occurs during the normal operation in the simultaneous operation.

The first controller 110 determines the operation state in response to the data input from the first detection unit 160, during a specified operation, and determines whether an error is occurred. As described above, the first controller 110 distinguishes between the case of performing the single operation and the case of performing the simultaneous operation, and determines whether an error is occurred based on different standard data.

The first controller 110 sets the wash water level corresponding to the amount of laundry and determines the state of the wash water through the counted water supply time, the draining time, the first water level sensor 161 or the first temperature sensor 162, and determines whether water supply error is occurred.

For example, the first controller 110 determines that water supply error is occurred, when the water supply time exceeds the set value of preset standard data, when the wash water level is not changed during the water supply, when the temperature of the wash water is not detected or the temperature of the wash water is out of the setting range. During the simultaneous operation, the first controller 110 determines a water supply error based on the water supply time of the simultaneous operation according to the changed standard data.

The first controller 110 determines the failure of the laundry processing apparatus based on the supplied voltage, the rotational speed of the motor, the heater temperature, the wash water heating time, the current of the motor, the temperature of control circuit, and the like as well as the water supply error. At this time, the first controller 110 determines whether the error is occurred based on the standard data for simultaneous operation or the standard data for single operation according to the simultaneous operation mode setting.

As described above, the first controller 110 can determine whether the simultaneous operation is performed, when the first communication unit is not provided, or even if separate communication with the second washing part is not performed, when a simultaneous operation key is input or the simultaneous operation is determined by using the water supply time.

In addition, when the standard data for the simultaneous operation does not exist in the first data unit 120, the first controller 110 may generate the standard data for the simultaneous operation based on the data measured during operation. In the simultaneous operation mode, the first controller 110 measures the water supply time, the draining time, the water level change amount, the heating target temperature of the heater, and the wash water heating time, and stores them as the standard data for simultaneous operation and uses the data in the next operation.

Figure 4:
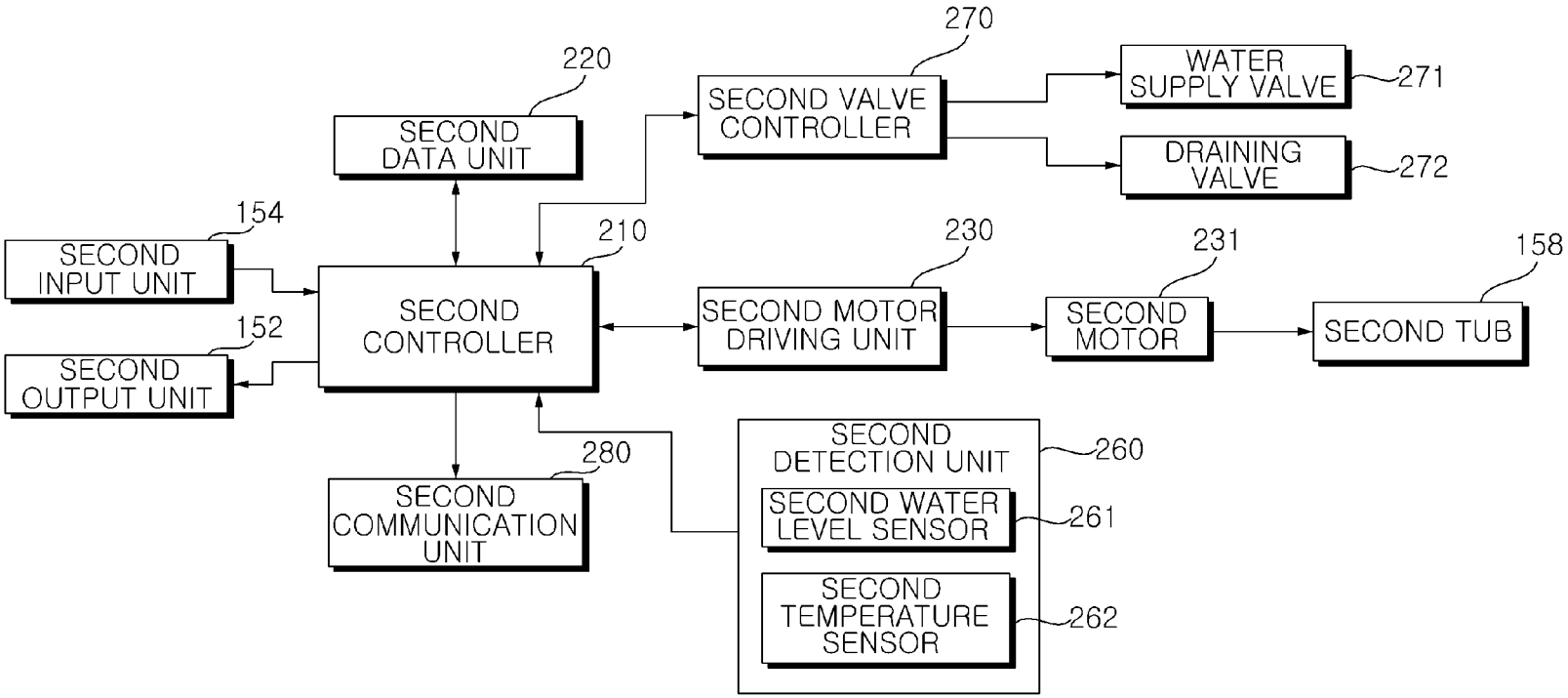
FIG. 4 is a block diagram illustrating a configuration of a second washing part of a laundry processing apparatus according to an embodiment of the present invention.

FIG. 4 is a block diagram illustrating a configuration of a second washing part of a laundry processing apparatus according to an embodiment of the present invention.

As shown in FIG. 4, the second washing part 150 includes a second input unit 154, a second output unit 152, a second tub 158, a second motor 231, a second motor driving unit 230, a second valve controller 270, a water supply valve 271, a draining valve 272, a second detection unit 260, a second communication unit 280, a second data unit 220, and a second controller 210 for controlling the overall operation of the second washing part.

Since a configuration of the second washing part 150 is similar to the configuration of the first washing part 140 of FIG. 3 described above, a description thereof will be omitted below.

The second controller 210 transmits the operation data to the first washing part through the second communication unit 280, when the operation setting is inputted and the washing is performed.

The second controller 210 sets the simultaneous operation mode, when the simultaneous operation key is input through the second input unit 154, when the data for the simultaneous operation is input, when the water supply time exceeds the set time, or when the operation data of the first washing part 140 is received through the second communication unit 280.

The second controller 210 changes the standard data for determining the error when the simultaneous operation mode is set, and determines whether the error for the second washing part is occurred based on the standard data according to the simultaneous operation.

Figure 5:
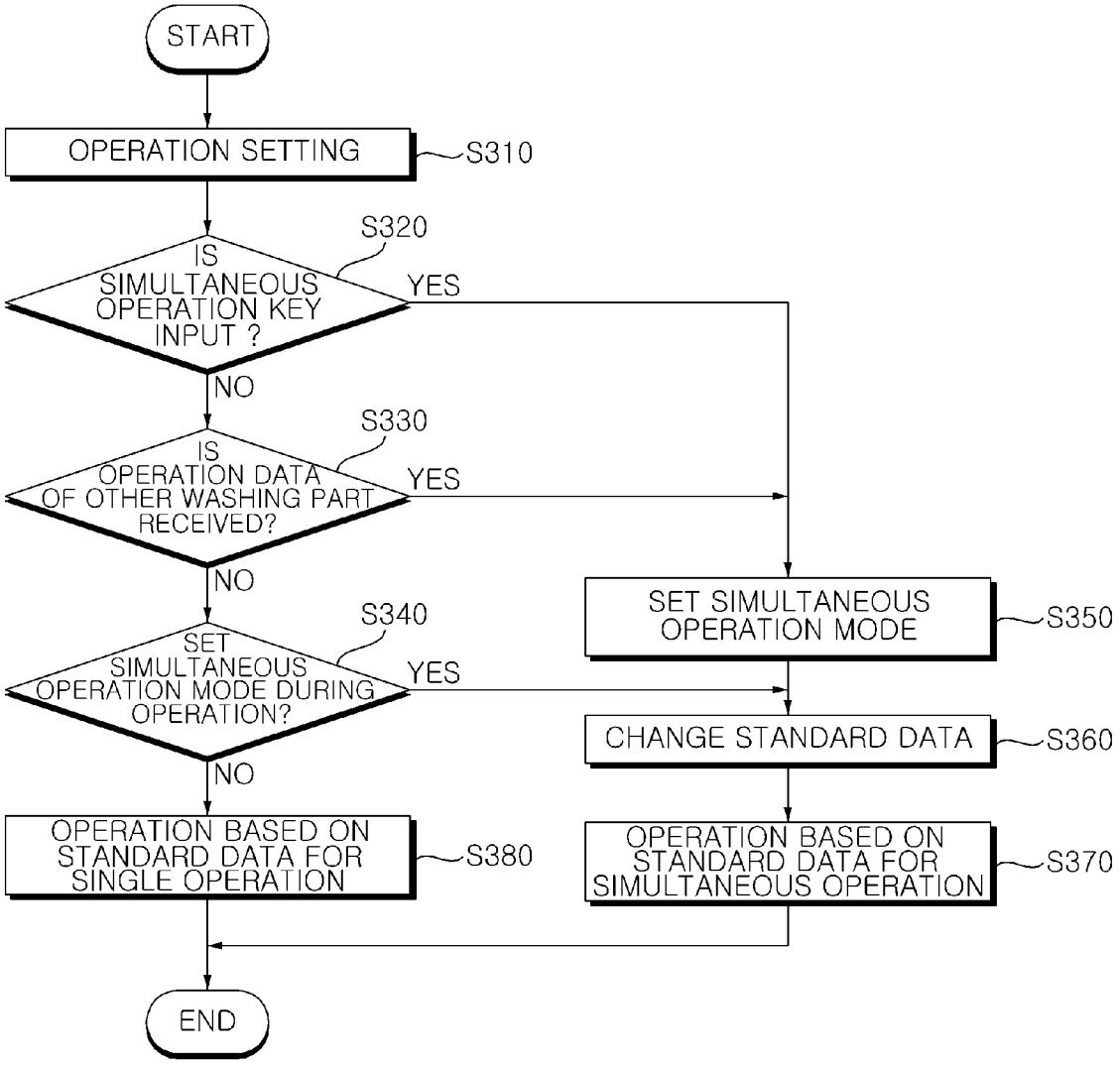
FIG. 5 is a flowchart illustrating a control method according to a simultaneous operation mode setting of a laundry processing apparatus according to an embodiment of the present invention.

FIG. 5 is a flowchart illustrating a control method according to a simultaneous operation mode setting of a laundry processing apparatus according to an embodiment of the present invention.

As shown in FIG. 5, the operation setting for the washing course, the wash water temperature, and the like is inputted through the first input unit 144 (S310), and the first controller 110 performs washing according to the inputted operation setting.

The first controller 110 applies a control signal to the first motor driving unit 130 so that the amount of the laundry is detected as the first motor 131 operates, sets the water level corresponding to the detected laundry amount, and calculates the washing time to output it through the first output unit 142.

At this time, before starting washing, the first controller 110 determines whether the simultaneous operation key is input through the first input unit 144 (S320). When the simultaneous operation key is input, or when there exists a key input corresponding to the simultaneous operation key, i.e., when the data for simultaneous operation is inputted through a plurality of key inputs, the first controller 110 determines that the first washing part and the second washing part operate simultaneously and sets the simultaneous operation mode (S350).

In addition, the first controller 110 determines whether operation data for the second washing part is received from the second washing part 150 through the first communication unit 180 (S330).

When the operation data of the second washing part is received, the first controller 110 determines that the first washing part and the second washing part operate simultaneously and sets the simultaneous operation mode (S350).

When the simultaneous operation key is input or the operation data of the second washing part is received to set the simultaneous operation mode, the first controller 110 changes the standard data into the standard data for simultaneous operation (S360).

At this time, when setting the simultaneous operation mode, the first controller 110 changes the standard data for at least one of the water supply time, the draining time, the heating target temperature of the heater, and the wash water heating time.

Meanwhile, the first controller 110 controls the washing operation to be performed by the single operation when the simultaneous operation key is not input and the operation data of the second washing part is not received.

At this time, when setting the simultaneous operation mode in response to the operation state of the first washing part or the detection data of the first detection unit 160 during the washing operation (S340), the first controller 110 changes the standard data into the standard data for simultaneous operation (S360).

In addition, the first controller 110 may set the simultaneous operation mode during operation, when the simultaneous operation key is input or the operation data of the second washing part is received during the washing operation.

The first controller 110 determines an error for the first washing part based on the changed standard data, i.e., the standard data for simultaneous operation, and controls the operation (S370).

When the simultaneous operation mode is not set during the washing operation, the first controller 110 determines an error for the first washing part based on the standard data for single operation and controls the operation (S380).

For example, when water is supplied simultaneously to the first washing part and the second washing part during the simultaneous operation, the first controller 110 determines whether water supply error is occurred based on the water supply time according to the standard data for simultaneous operation with respect to the water supply time which is increased in comparison with the single water supply. That is, assuming that the water supply time of 20 minutes during the single water supply and the water supply time of 35 minutes during the simultaneous water supply are the set time of error determination, the first controller does not determine the water supply error even if the water supply time exceeds 20 minutes, and determines the water supply error in the case of exceeding minutes. Meanwhile, since it is determined based on the standard data for simultaneous operation during the single water supply, the first controller can determine that the water supply error is occurred when the water supply time exceeds 20 minutes.

The first controller 110 determines an error with respect to the water supply time, the draining time, the water level change amount, the heater heating target temperature, and the wash water heating time according to the set standard data, during the washing operation.

Figure 6:
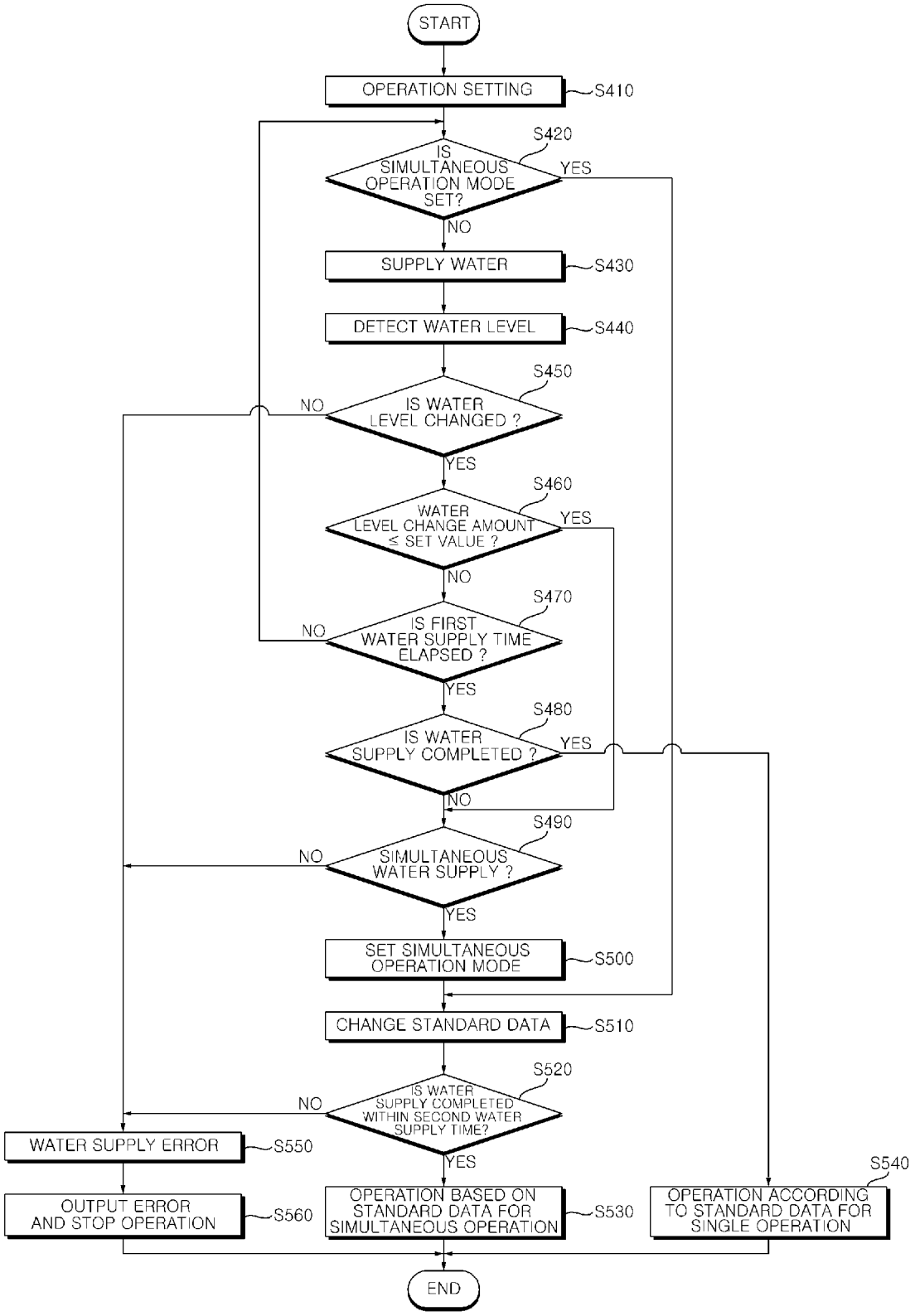
FIG. 6 is a flowchart illustrating an error determination method according to a water supply time of a laundry processing apparatus according to an embodiment of the present invention.

FIG. 6 is a flowchart illustrating an error determination method according to a water supply time of a laundry processing apparatus according to an embodiment of the present invention.

As shown in FIG. 6, the operation setting is inputted through the first input unit 144 (S410), and the first controller 110 performs washing according to the inputted operation setting.

At this time, the first controller 110 determines whether the simultaneous operation mode is set before starting the operation (S420). As described above, the first controller 110 determines the simultaneous operation mode setting in response to the input of the simultaneous operation key or the reception of the operation data of the second washing part.

When the simultaneous operation mode is not set, the first controller 110 controls the first motor driving unit 130 to determine the amount of laundry and set the wash water level and calculate the washing time.

In addition, the first controller 110 applies a control command to the first valve controller 170 and supplies the wash water to the first tub 148 (S430).

The first water level sensor 161 detects the level of the wash water during the water supply and inputs water level data to the first controller 110 (S440). At this time, the first controller 110 determines whether the water level of the wash water changes in correspondence with the water level data inputted from the first water level sensor 161 (S450), and determines as a water supply error, when the water level of the wash water does not change for the set time or more (S550).

Meanwhile, when the water level of the wash water changes, the first controller 110 calculates the water level change amount and compares the water level change amount with the set value (S460).

When the water level change amount is equal to or greater than the set value, the first controller 110 determines whether a first water supply time is elapsed (S470). At this time, the first water supply time is a set time for the water supply time during the single operation.

When the first water supply time is not elapsed, the first controller 110 continue to supply water, and continuously determines whether the simultaneous operation mode is set during water supply, the water level change amount, and whether the first water supply time is elapsed (S420 to S470).

When the first water supply time is elapsed, the first controller 110 compares the water level of the wash water with the set water level based on the water level data detected by the first water level sensor 161 to determine whether the water supply is completed (S480).

When the water supply is completed, the first controller 110 determines that the first washing part operates solely, and controls the operation according to the standard data for single operation to determine an error (S540).

Meanwhile, when the water supply is not completed until the first water supply time is elapsed, or when the water level change amount is equal to or less than the set value, the first controller 110 determines whether the water is simultaneously supplied (S490). When the water level change amount is equal to or less than the set value, or when the water level change amount is equal to or more than the set value and the water supply is not completed until the first water supply time is elapsed, the first controller 110 determines that the water is simultaneously supplied. In some cases, the first controller 110 may detect the water pressure and determine whether the water is simultaneously supplied.

In the case of the simultaneous water supply, the first controller 110 sets a simultaneous operation mode (S500), and changes the standard data into the standard data for simultaneous operation (S510). Even when the simultaneous operation mode is set during operation (S420), the first controller 110 changes the standard data (S510).

When the water supply is completed within a second water supply time (S520), it is a water supply delay due to simultaneous water supply as the first washing part and the second washing part operate simultaneously, so that the first controller 110 controls the operation of the first washing part based on the standard data for simultaneous operation with respect to the subsequent operation and determines an error during the operation (S530). At this time, the second water supply time is a set time for the water supply time during the simultaneous operation.

When setting the simultaneous operation mode, the first controller 110 transmits information on the simultaneous operation mode setting to the second washing part through the first communication unit. Accordingly, the second washing part also sets the simultaneous operation mode and changes the standard data to perform washing.

Meanwhile, when the water level is not changed during the water supply, or when the water supply is not completed within the first water supply time in the single water supply state instead of the simultaneous water supply, the first controller 110 determines that there is a problem in the water supply (S550).

In case of water supply error, the first controller 110 outputs an error code according to the water supply error or a certain warning sound through the first output unit 142, and stops the operation as the washing operation cannot progress. (S560).

Figure 7:
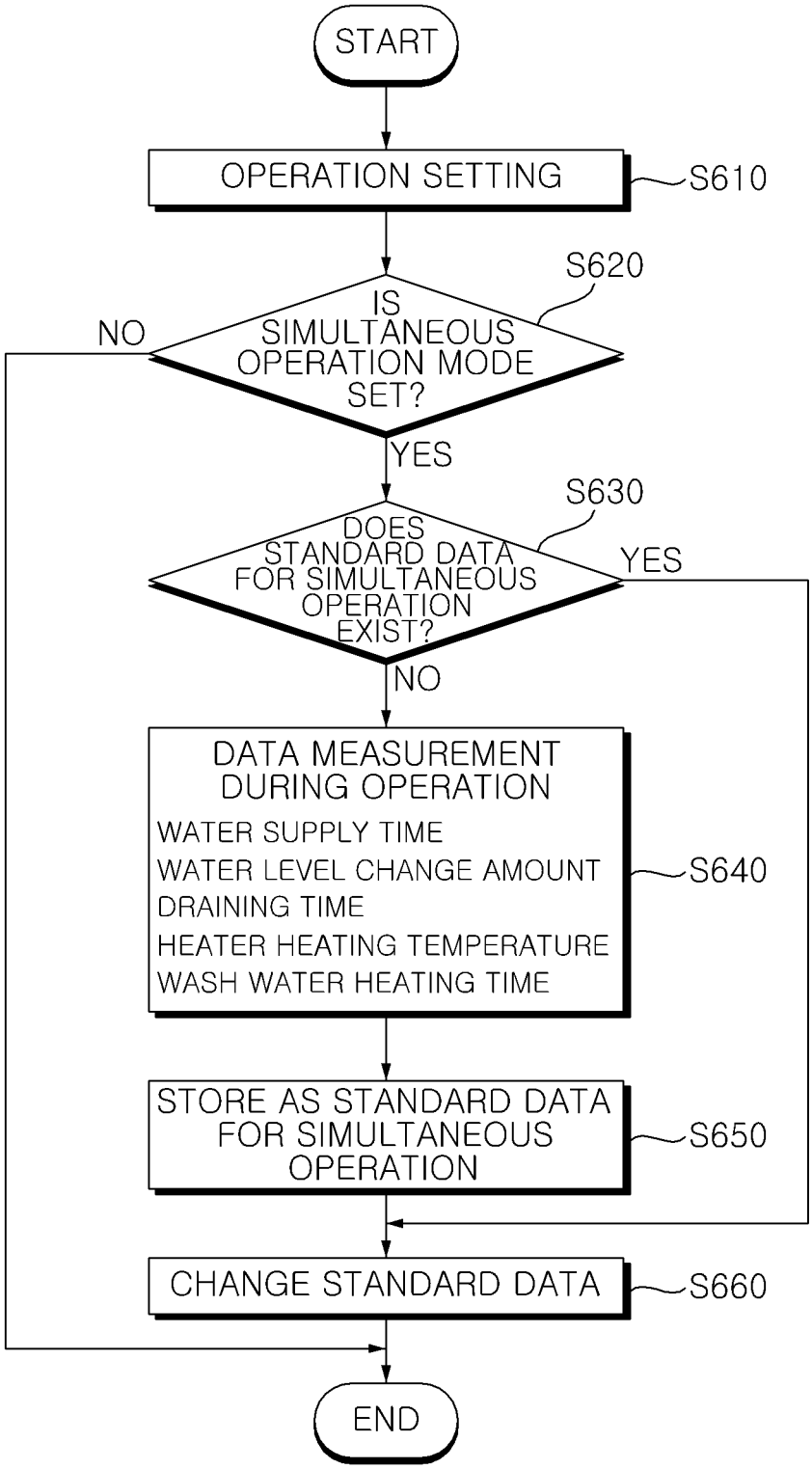
FIG. 7 is a flowchart illustrating a standard data setting method of a laundry processing apparatus according to an embodiment of the present invention.

FIG. 7 is a flowchart illustrating a standard data setting method of a laundry processing apparatus according to an embodiment of the present invention.

As shown in FIG. 7, the operation setting is input (S610), and the first controller 110 determines whether the simultaneous operation mode is set (S620).

When the simultaneous operation mode is set before or during the operation, the first controller 110 determines whether the standard data for simultaneous operation exists in the first data unit 120 (S630). When the standard data for simultaneous operation exists, the first controller 110 changes the standard data into the standard data for simultaneous operation to perform washing (S660).

Meanwhile, when, the standard data for simultaneous operation does not exist in the first data unit 120, the first controller 110 applies a control command to the first valve controller and the first motor driving unit 130 according to the set operation setting to perform washing.

The first controller 110 counts the water supply time and the draining time when the washing is performed according to the operation setting, stores the time required to complete water supply or draining, calculates and stores the water level change amount in correspondence with the detected water level, and measures and stores the heating target temperature of the heater and the heating time of the wash water.

The first controller basically controls the operation on the basis of the standard data for single operation. However, in some cases, the washing can be performed without outputting a separate error code while data is stored for the standard data for simultaneous operation.

When the washing is completed, the first controller 110 stores the data stored in the washing operation, as the standard data for simultaneous operation, in the first data unit 120 (S650). In some cases, the first controller 110 may receive the simultaneous operation data from the outside through the first communication unit 180 and store in the first data unit 120.

When the simultaneous operation mode is set in the next washing operation, the first controller 110 changes the standard data into the stored standard data for simultaneous operation, and performs washing and determines an error (S660).

Accordingly, the present invention relates to the first washing unit and the second washing unit that independently perform washing, sets the standard data according to the simultaneous operation and the standard data according to the single operation separately, and, when the first washing part and the second washing part simultaneously operate, changes and applies the standard data, thereby preventing unnecessary error from occurring in a normal operation state.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A laundry processing apparatus comprising:

a first washing part having a first tub;

a second washing part having a second tub and operating independently of the first washing part;

a water level sensor configured to detect a level of wash water that is supplied to the first tub; and a controller configured to control the first washing part, wherein:

the controller is configured to determine whether the first washing part and the second washing part operate simultaneously based on at least one of an operation state of the laundry processing apparatus or operation data of the second washing part, and set a simultaneous operation mode when the first washing part and the second washing part operate simultaneously, and when the simultaneous operation mode is set, the controller is configured to change standard data for determining an operating state of the first washing part, and to control operation of the first washing part according to the changed standard data, wherein the controller is configured to determine a water level change based on the level of wash water of the first tub detected by the water level sensor and, when the water level change is equal to or less than a set value, determine that water supply is being performed during simultaneous operation of the first washing part and the second washing part and to set the simultaneous operation mode, wherein the set value is a water level change amount when wash water is supplied only to the first tub, and wherein the standard data is a standard for an error determination on the operation of the first washing part.

2. The apparatus of claim 1, wherein the controller is configured to determine that failure of water supply occurred and to output an error when the level wash water of the first washing part is not changed for a certain time.

3. The apparatus of claim 1, wherein the controller is configured to set the simultaneous operation mode when water supply time of the first washing part exceeds a set time.

4. The apparatus of claim 1, wherein the controller is configured to set the simultaneous operation mode when receiving the operation data of the second washing part during the operation of the first washing part.

5. The apparatus of claim 1, wherein the controller is configured to:

measure and store a water supply completion time and a water level change amount of the first washing part when the simultaneous operation mode is set, and determine whether the first washing part and the second washing part simultaneously operate based on stored data and to set the simultaneous operation mode in a next operation.

6. The apparatus of claim 1, wherein the controller is configured to change the standard data for at least one of a water supply time, a draining time, a heating target temperature of a heater, or a wash water heating time.

7. The apparatus of claim 1, wherein, after setting the simultaneous operation mode, the controller is configured to determine a water supply time of the first washing part, compare the water supply time with a changed water supply time, and output a water supply error when the water supply is not completed within the changed water supply time, in response to the changed standard data.

8. The apparatus of claim 1, wherein the controller is configured to transmit information on simultaneous operation mode setting to the second washing part, when the simultaneous operation mode is set.

9. A method of controlling a laundry processing apparatus comprising a first washing part having a first tub and a second washing part having a second tub and operating independently of the first washing part, the method comprising:

determining whether the first washing part and the second washing part operate simultaneously, and setting a simultaneous operation mode when the first washing part and the second washing part operate simultaneously, by a controller for the first washing part;

changing standard data for the first washing part when the simultaneous operation mode is set, wherein the standard data is a standard for an error determination on the operation of the first washing part; and controlling operation of the first washing part according to the changed standard data, wherein determining whether the first washing part and the second washing part operate simultaneously includes:

detecting a water level of wash water supplied to the first tub;

determining a water level change based on the water level of wash water supplied to the first tub; and when the water level change is equal to or less than a set value, determining that the first washing part and the second washing part are simultaneously operating while wash water is being supplied, the set value corresponding to a water level change amount in the first washing part when wash water is supplied to the first washing part while the second washing part is not operating.

10. The method of claim 9, further comprising determining that failure of water supply is occurred and outputting an error when the level of washing water in the first washing part is not changed for a certain time.

11. The method of claim 9, further comprising counting a water supply time of the first washing part and comparing the water supply time with a set time, wherein the simultaneous operation mode is set when the water supply time exceeds the set time.

12. The method of claim 9, further comprising receiving operation data from a second controller of the second washing part during operation of the first washing part, wherein the simultaneous operation mode is set in response to the operation data.

13. The method of claim 9, further comprising:

measuring and storing a water supply completion time and a water level change amount of the first washing part when the simultaneous operation mode is set, wherein it is determined whether the first washing part and the second washing part simultaneously operate based on stored data and the simultaneous operation mode is set, in a next operation.

14. The method of claim 9, wherein, when the simultaneous operation mode is set, the standard data for at least one of a water supply time, a draining time, a heating target temperature of a heater, and a wash water heating time is changed.

15. The method of claim 9, further comprising transmitting a signal for simultaneous operation mode setting to the second washing part by the controller, after the simultaneous operation mode is set.

* * * * *